US006174010B1

(12) United States Patent
Fänger et al.

(10) Patent No.: US 6,174,010 B1
(45) Date of Patent: Jan. 16, 2001

(54) SUSPENSION SYSTEM FOR ATTACHING A LOAD-BEARING MEMBER TO A LIFTING MECHANISM OF A HOISTING APPARATUS FOR A PERSON

(75) Inventors: Alfred Fänger, Wetter; Udo Gersemsky, Herdecke; Heinz Hasselmann, Hagen; Janus Nedza, Bochum; Thilo Walloschek, Witten, all of (DE)

(73) Assignee: Mannesmann AG, Düsseldorf (DE)

( * ) Notice: Under 35 U.S.C. 154(b), the term of this patent shall be extended for 0 days.

(21) Appl. No.: 09/235,048

(22) Filed: Jan. 21, 1999

(30) Foreign Application Priority Data

Jan. 21, 1998 (DE) ..... 198 02 894

(51) Int. Cl.[7] ..... A61G 7/10; B66C 13/04

(52) U.S. Cl. ..... 294/81.4; 5/89.1; 294/82.12; 414/921

(58) Field of Search ..... 294/67.5, 74, 81.3, 294/81.4, 82.12, 86.41; 5/81.1 R, 83.1, 85.1, 87.1, 88.1, 89.1; 414/626, 756, 921

(56) References Cited

U.S. PATENT DOCUMENTS

| | | | | |
|---|---|---|---|---|
| 1,961,119 | | 5/1934 | Ettinger . | |
| 3,957,164 | * | 5/1976 | Brown | 414/921 X |
| 4,627,119 | | 12/1986 | Hachey et al. . | |
| 4,639,955 | * | 2/1987 | Carminati et al. | 414/921 X |
| 5,072,840 | * | 12/1991 | Asakawa et al. | 414/921 X |
| 5,077,844 | | 1/1992 | Twitchell et al. . | |

FOREIGN PATENT DOCUMENTS

| | | | | |
|---|---|---|---|---|
| 30 37 138 A1 | | 4/1982 | (DE) . | |
| 41 26 402 C2 | | 2/1993 | (DE) . | |
| 42 25 851A1 | | 4/1993 | (DE) . | |
| 43 16 656 | | 12/1993 | (DE) . | |
| 295 02 203 U | | 6/1995 | (DE) . | |
| 297 07 130 U1 | | 9/1997 | (DE) . | |
| 353 478 | | 9/1905 | (FR) . | |
| 1320218 | * | 1/1963 | (FR) | 294/82.12 |
| 2 295 602 | | 6/1996 | (GB) . | |
| 751779 | * | 7/1980 | (SU) | 294/82.12 |
| 1599296 | * | 10/1990 | (SU) | 294/82.12 |
| WO 93/15705 A1 | | 8/1993 | (WO) . | |
| WO 94/22759 A1 | | 10/1994 | (WO) . | |
| WO 97 20 535 | | 6/1997 | (WO) . | |

* cited by examiner

*Primary Examiner*—Johnny D. Cherry
(74) *Attorney, Agent, or Firm*—Henry M. Feiereisen

(57) ABSTRACT

A suspension system for attaching a load-bearing member to a lifting mechanism of a hoisting apparatus for a person, in particular a handicapped person in sitting or recumbent disposition, includes a framework having at least three tow lines secured to the lifting mechanism and extending downwardly for attachment to the load-bearing member at points of securement positioned in front and behind a viewing direction of a person carried by the load-bearing member, thereby defining front and rear tow lines, wherein the front and rear tow lines are movable in opposition to one another in vertical direction.

17 Claims, 2 Drawing Sheets

SUSPENSION SYSTEM FOR ATTACHING A LOAD-BEARING MEMBER TO A LIFTING MECHANISM OF A HOISTING APPARATUS FOR A PERSON

CROSS-REFERENCES TO RELATED APPLICATIONS

This application claims the priority of German Patent Application, Serial No. 198 02 894.6-32, filed Jan. 21, 1998, the subject matter of which is incorporated herein by reference.

BACKGROUND OF THE INVENTION

The present invention relates in general to a suspension system for attaching a load-bearing member to a lifting mechanism of a hoisting apparatus for a person, especially a handicapped person in sitting or recumbent disposition, and in particular relates to a suspension system of a type including a framework having at least three tow lines secured to the lifting mechanism and extending downwardly for attachment to the load-bearing member at points of securement positioned in front and behind a viewing direction of a person carried by the load-bearing member.

German Pat. No. DE 42 25 851 A1 describes a transport device which includes a running gear which travels on a rail in an operating direction, and a lifting mechanism which depends from the running gear via a flat belt. Arranged at the forward end and at the rearward end of the lifting mechanism, as viewed in operating direction, are two carriers which are aligned transversely to the operating direction and deflect tow lines downwardly. A load-bearing member for support of a person is secured to the tow lines at their ends distant to the carriers.

A drawback of this type of suspension for securing the load-bearing member to the lifting mechanism is the inability to permit a simple and convenient positional change of the person, in particular a change from a seated disposition into a recumbent disposition, or vice versa.

SUMMARY OF THE INVENTION

It is thus an object of the present invention to provide an improved suspension system, obviating the afore-stated drawbacks.

In particular, it is an object of the present invention to provide an improved suspension system for securing a load-bearing member to a lifting mechanism, by which a positional change of the person being transported is realized in a simple manner.

These objects, and others which will become apparent hereinafter, are attained in accordance with the present invention by providing a framework having tow lines secured to the lifting mechanism and extending downwardly for attachment to the load-bearing member at points of securement positioned in front and behind a viewing direction of a person carried by the load-bearing member, thereby defining front and rear tow lines wherein the front and rear tow lines are movable in opposition to one another in a vertical direction.

Through the provision of a suspension system according to the present invention, the position of the person to be transported can be easily changed, in particular from a sitting into a recumbent position, or vice versa. The positional change may be initiated by the person himself or herself, or remote-controlled via a drive motor.

In order to transport the person, which has been elevated by the hoisting apparatus, in a simple manner, the lifting mechanism is secured to a running gear which travels on a rail, with the tow lines, as viewed in travel direction, being mounted to the load-bearing member at the front and at the rear thereof. Preferably, the front and rear tow lines are moved at different speeds so as to keep the forces small for realizing the positional change. Typically, a positional change of a person results in an elevation or lowering of the mass center, whereby the forces to be applied in this context complicate the positional change and require e.g. the need for a powerful motor. By moving the tow lines in the head and foot areas of the person to be transported at different speeds, as described in accordance with the present invention, the mass center can be maintained in place without encountering an elevation or lowering when suitably selecting the speed difference.

According to another feature of the present invention, the tow lines are positioned in the form of a very stable three-point suspension framework, with a single front tow line secured at the front area and a pair of rear tow lines secured at the rear area of the load-bearing member, whereby the front tow line and the two rear tow lines are deflected downwardly by associated pulleys, and whereby the movements of the rear tow lines and the front tow line are linked to one another by a coupling unit for realizing the optimum speed differential of the tow lines when the person being transported is re-positioned.

According to still another feature of the present invention, additional base load tow lines are provided between the lifting mechanism and the load-bearing member and positioned as mirror images to each other with respect to the center plane of the lifting mechanism on both sides thereof to thereby keep the load and the forces to be applied for changing the position of a person being transported at a small level. The absorption of the base load is optimized when the base load tow lines extend near or coincide with the vertical gravity center plane of the load-bearing member under load, with the gravity center plane extending transversely to the travel direction of the lifting mechanism.

A compensation of lateral weight shifts can be realized in accordance with the present invention, by guiding the ends of the pair of rear tow lines over respective pulleys for downward deflection, whereby the pulleys are supported on a crossbar which extends transversely to the travel direction and is swingable about a pivot axis oriented essentially parallel to the travel direction and coinciding with the center plane of the lifting mechanism.

Suitably, the pair of rear tow lines are trained over a common drum, and the single front tow line is trained over a separate drum for realizing respective winding and unwinding actions. A further simplification of the suspension system of the present invention can be realized when mounting the drums for the rear tow lines and the front tow line in fixed rotative engagement and in spaced-apart relationship on a shaft which extends in travel direction. When connecting the shaft to a suitable motor, the person can then easily effect a positional change through appropriate control devices.

Preferably, the tow lines are formed as band-like straps of identical thickness, with the drums for the front tow line and rear tow lines having different diameters.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
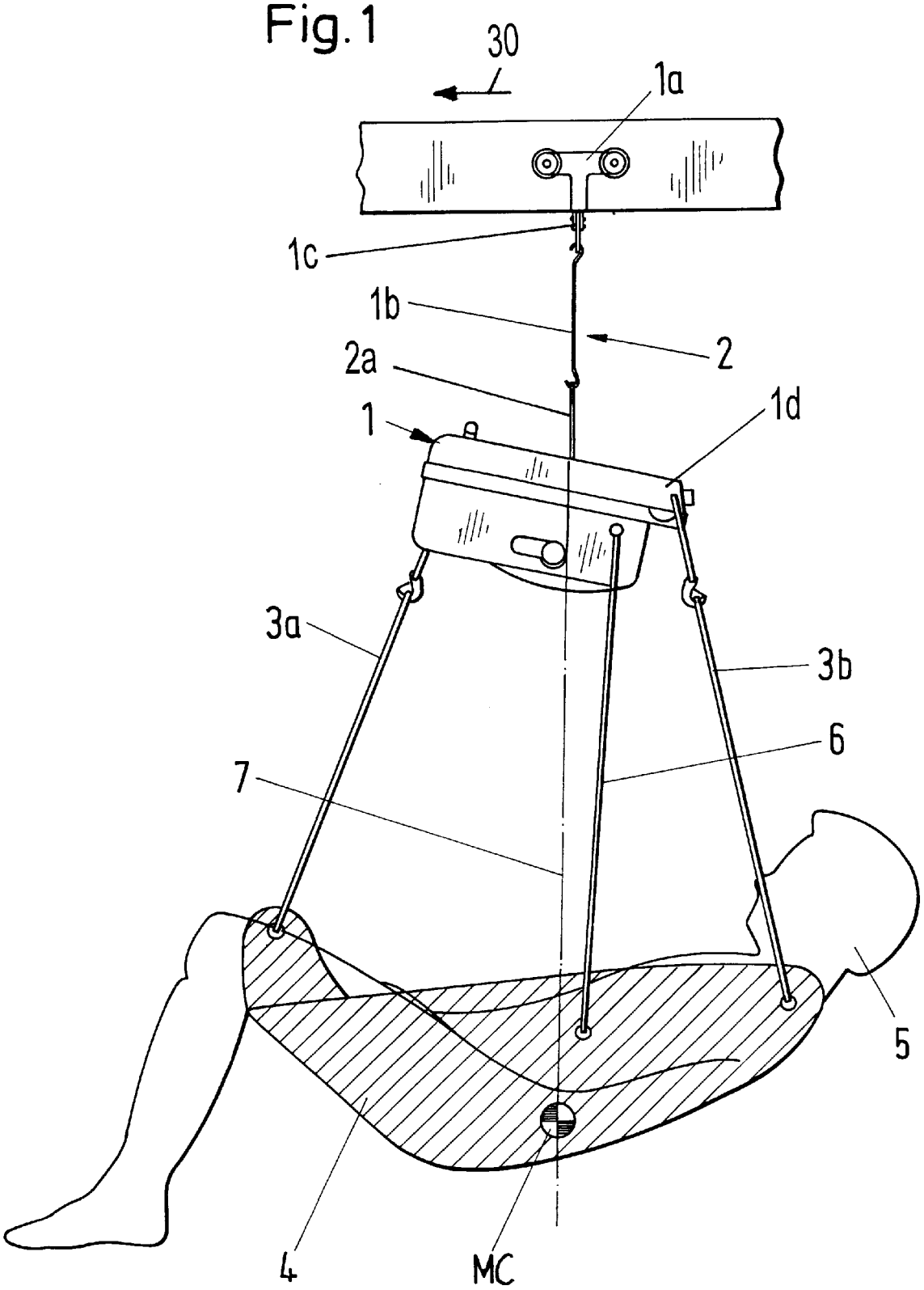
FIG. 1 is a schematic side view of a hoisting apparatus according to the present invention for transport of a person.

Throughout all the Figures, same or corresponding elements are generally indicated by same reference numerals.

Turning now to the drawing, and in particular to FIG. 1, there is shown a schematic side view of a hoisting apparatus according to the present invention for transport of a person 5. The hoisting apparatus includes a running gear 1*a* which travels along a rail 18 in an operating or travel direction, indicated by double arrow 30, and a lifting mechanism, generally designated by reference numeral 1 and having a housing 1*d*. The lifting mechanism 1 depends from the running gear 1*a* via a tow line, which is generally designated by reference numeral 2 and exhibits a low flexural strength. The tow line 2 includes a clip 1*b* having opposite hooked ends, and a flat strap 2*a* which is secured on one end to the confronting hooked end of the clip 1*b*. The other hooked end of the clip 1*b* is secured to a mount 1*c* on the running gear 1*a*.

Suspended from the lifting mechanism 1 is a load-bearing member 4 for support of a person 5 to be transported, e.g. a handicapped person 5. The load-bearing member 4 is made of a fabric and is mounted to the lifting mechanism 1 by further tow lines 3*a*, 3*b* which are provided in form of flat straps and described in more detail with reference to FIG. 2.

Hoisting of the person 5 to be transported is realized by the lifting mechanism 1 which is moved upwards and downwards via the flat strap 2*a* by winding and unwinding the strap 2*a*. The lifting mechanism 1 thus pulls itself upwards and downwards, with the control of this movement being realized by the person 5 being transported or by a nurse. Suitably, the flat strap 2*a* is guided between two pulleys (not shown) which are supported in parallel relationship by the housing 1*d* of the lifting mechanism 1 and rotatable about respective pivot axes which extend perpendicular to the travel direction 30 of the lifting mechanism 1.

In FIG. 1, the person 5 is shown in recumbent position. A positional change of the person 5 requires application of forces which correspond to the weight portions desired to be shifted, i.e. elevated or lowered. In order to reduce the forces to be applied, a part of the person's weight is received by an additional pair of base load tow lines 6 (only one is visible in FIG. 1) which are secured to the load-bearing member 4. The lifting mechanism 1 is defined by a center plane CP (FIG. 2), with the base load tow lines 6 being arranged as mirror images of each other with respect to the center plane CP on both sides of the lifting mechanism 1 and attached to the load-bearing member 4. It will be appreciated by persons skilled in the art that the center plane CP is to be understood as the central vertical plane as viewed in travel direction 30 with respect to the lifting mechanism 1 and coinciding with the plane of symmetry of the rail 18. As further shown in FIG. 1, the base load tow lines 6 extend in proximity to a vertical plane of center of gravity 7 of the loaded load-bearing member 4 which plane of center of gravity 7 is oriented transversely to the travel direction 30, with the center of mass MC lying approximately also in the plane of center of gravity 7.

Figure 2:
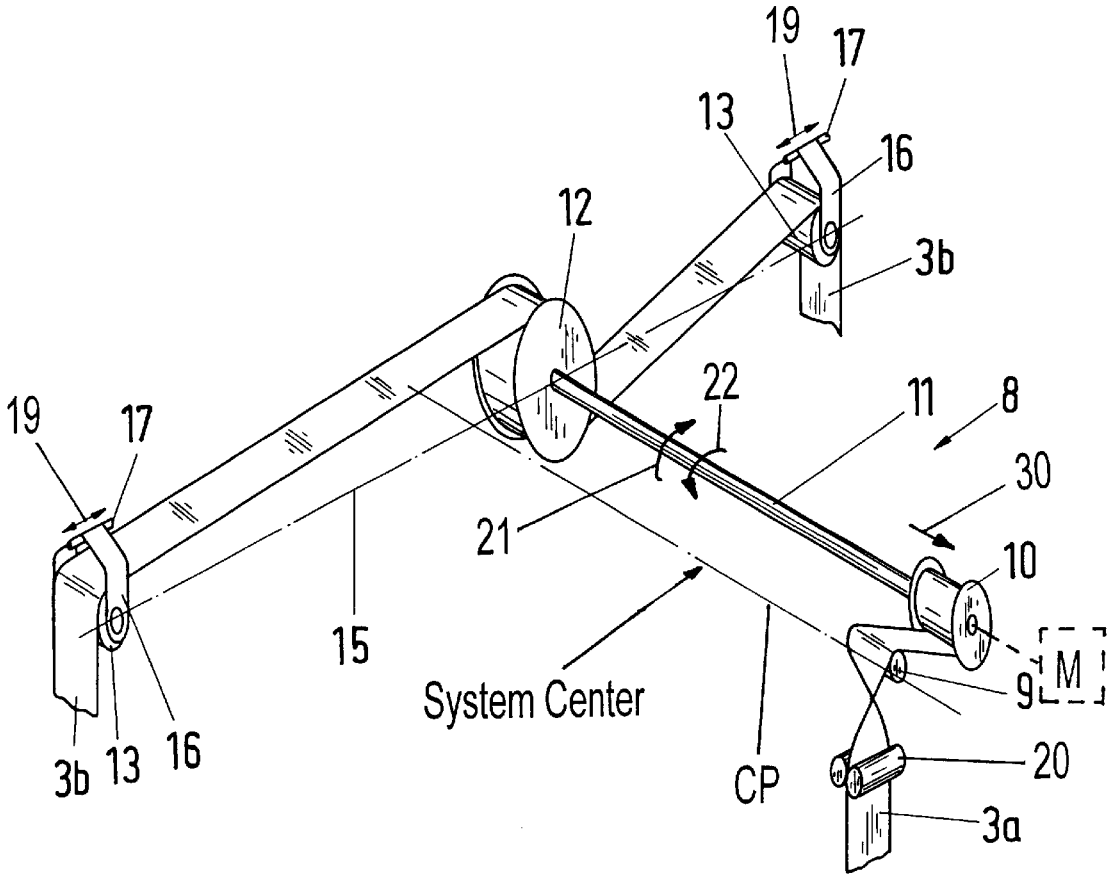
FIG. 2 is a schematic, perspective illustration of a suspension system for use in the hoisting apparatus of FIG. 1.

Turning now to FIG. 2, there is shown a schematic, perspective view of a suspension system for securing the load-bearing member 4 to the lifting mechanism 1. The suspension system includes a coupling unit 8 for linking the straps 3*a*, 3*b* to one another to thereby coordinate their movements. The straps 3*a*, 3*b* are configured in the form of a three-point suspension framework and deflected downwardly from the lifting mechanism 1 for attachment to the load-bearing member 4. As viewed in travel direction 30, a single front strap, namely the strap 3*a*, extends in the center plane CP of the lifting mechanism 1 between the lifting mechanism 1 and the load-bearing member 4 in front of a viewing range of the person 5, while two rear straps, namely the straps 3*b*, extend behind the viewing range of the person 5 and thus trail the strap 3*a* in travel direction 30. The rear straps 3*b* are deflected downwardly toward the load-bearing member 4 at a distance from one another transversely to the travel direction 30 and extend in a common plane.

The single front strap 3*a* is deflected at the upper end thereof by a deflection pulley 9 towards a drum 10 by which the strap 3*a* is wound or unwound. The drum 10 is mounted in fixed rotative engagement on one end of a shaft 11 which may, optionally, also be driven by a motor M, as indicated by broken line in FIG. 1. At its other drum-distal end, the shaft 11 is connected in fixed rotative engagement to a further drum 12 for commonly winding and unwinding the pair of straps 3*b* depending on the direction of rotation of the shaft 11. The straps 3*b* are further trained over pulleys 13 for downward deflection toward the load-bearing member 4 at a distance from one another, as shown in FIG. 2, whereby the straps 3*b* are arranged as mirror images to each other with respect to the center plane CP of the lifting mechanism 1. The pulleys 13 are freely rotatably supported by the lifting mechanism or, as shown in FIG. 2, supported on a crossbar 15 which is illustrated only schematically for sake of simplicity. The crossbar 15 extends transversely to the travel direction 30 of the lifting mechanism 1 and is swingably supported for rotation about a pivot axis over a pre-selected angular range, whereby the pivot axis extends essentially parallel to the travel direction 30 and lies in the center plane CP of the lifting mechanism 1. Suitably, the crossbar 15 may be swingably arranged directly at the end face of the housing 1*d* of the lifting mechanism 1 to thereby reduce the overall structural height and to increase the useful hoisting height. The pulleys 13 are suitably rotatably supported in mountings 16 which are swingably attached to cylinders 17 so as to be freely movable in a direction transversely to the travel direction 30 within a predetermined range, as indicated by double arrow 19.

As further shown in FIG. 2, the path of the single strap 3*a* is directed after deflection about the pulley 9 through a gap between two parallel, neighboring rollers 20, whereby the strap 3*a* is twisted about a vertical axis by an angle of 90° in the transition zone between the deflection pulley 9 and the rollers 20. Thus, a swinging of the load-bearing member 4 in travel direction 30 is possible, whereby the rear straps 3*b* follow the swinging motion as a consequence of the swinging support of the mountings 16 on the cylinders 17. This configuration further reduces a stress upon the straps 3*a*, 3*b*.

The mode of operation of the crossbar 15 which is swingably mounted to the lifting mechanism 1 is as follows: In the event the mass center MC of the person 5 being transported is not positioned perpendicular underneath the center of gravity of the lifting mechanism 1, the crossbar 15 swings automatically to such an degree until the center mass MC and the center of gravity coincide in a common vertical plane. In this manner, a rubbing of the strap 2*a* against the housing 1*d* or against other components of the lifting mechanism 1 as a result of a tilting of the lifting mechanism 1 can be effectively eliminated. By guiding the strap 2*a* through two rollers in a manner described above, only a lateral tilting needs therefore to be compensated. The compensation of a lateral tilting action is realized by the suspension system according to the present invention.

As shown in FIG. 2, the pair of rearward straps 3*b,* on the one hand, and the single front strap 3*a,* on the other hand, are moved underneath the lifting mechanism 1 in opposition to one another in the vertical direction, so that the forward and rearward parts of the load-bearing member 4 move in opposition to one another. As a consequence of the fixed rotative connection of the drums 10, 12 on the opposite ends of the shaft 11, a rotation of the shaft 11 in direction of arrow 21 winds up the rear straps 3*b* while the front strap 3*a* unwinds. Thus, the rearward part of the load-bearing member 4 is raised with respect to the forward part, thereby shifting the person 5 into a sitting position. On the other hand, a rotation of the shaft in direction of arrow 22 unwinds the rear straps 3*b* while the front strap 3*a* is wound on the drum 10. Thus, the rearward part of the load-bearing member 4 is lowered with respect to the forward part, thereby shifting the person 5 into a recumbent position. Suitably, the drums 10 and 12 have different drum diameters so that the front strap 3*a* and the rearward straps 3*b* move at different speeds, i.e. different change of length per revolution. Thus, by suitably dimensioning the system, a lowering or elevation of the mass center MC during a positional change of the person 5 is predominantly prevented. The diameters of the drum 10, positioned on the foot end of the person 5, and of the drum 12, positioned at the head end of the person 5, can differ up to threefold, i.e. the diameter of the roller 12 may exceed the diameter of the roller 10 by up to three times. Although this relationship between the diameters of the drums 10, 12 is generally applicable in situations in which the straps 3*a,* 3*b* are of identical thickness, the effect as realized by providing different diameters of the drums 10, 12 can also be accomplished by straps 3*a* and 3*b* of different thickness.

An additional feature of this configuration is the fact that the ratio of the velocities of the front strap 3*a* and the rear straps 3*b* is not constant but changes as a result of the not-negligible strap thickness through modification of the respectively effective diameter of the drums 10, 12 in a predetermined range. An optimum selection of the drum diameters and the strap thickness enables a simple improved adjustment of the suspension to the positional change of the mass center MC of a person 5 at consideration of the uneven mass distribution of a human body.

While the invention has been illustrated and described as embodied in a suspension system for attaching a load-bearing member to a lifting mechanism of a hoisting apparatus for a person, it is not intended to be limited to the details shown since various modifications and structural changes may be made without departing in any way from the spirit of the present invention.

What is claimed as new and desired to be protected by Letters Patent is set forth in the appended claims:

1. A suspension system for attaching a load-bearing member to a lifting mechanism of a hoisting apparatus for a person, in particular a handicapped person in sitting or recumbent disposition, said suspension system comprising a framework having two base load tow lines extending downwardly from the lifting mechanism to the load-bearing member for substantially supporting the weight of a person, and tow lines secured to the lifting mechanism and extending downwardly for attachment to the load-bearing member defining front and rear tow lines which are so movable in opposition to one another in vertical direction as to rotate the person about its mass center, without substantially shifting the person's mass center.

2. The suspension system of claim 1 wherein the tow lines are of limited flexibility.

3. The suspension system of claim 1, and further comprising a running gear traveling along a rail in a travel direction, said lifting mechanism being arranged on the running gear, with the tow lines being secured to the load-bearing member at the front and the rear thereof as viewed in the travel direction.

4. The suspension system of claim 3 wherein the lifting mechanism defines a center plane, said two base load tow lines arranged on both sides of the center plane as mirror images of each other and extending near or in a vertical plane of center of gravity of the load-bearing member under load, whereby the plane of center of gravity is oriented transversely to the travel direction.

5. The suspension system of claim 1 wherein the front and rear tow lines are movable at different speeds.

6. The suspension system of claim 1 wherein the front and rear tow lines are positioned in the form of a three-point suspension with a single front tow line which is trained over a pulley for downward deflection, and with two rear tow lines which are trained over second pulleys for downward deflection, and further comprising a coupling means for linking movements of the two rear tow lines and the single front tow line.

7. The suspension system of claim 6, and further comprising a drive mechanism for moving the lifting mechanism in a travel direction, said coupling means including a crossbar which extends transversely to the travel direction and has opposite axial ends, with one of the axial ends supporting one of the second pulleys and the other one of the axial ends supporting the other one of the second pulleys, said crossbar being swingable about an axis which is substantially parallel to the travel direction and extends in a center plane of the lifting mechanism.

8. The suspension system of claim 6, and further comprising a drive mechanism for moving the lifting mechanism in a travel direction, said coupling means includes a first drum and a second drum, said two rear tow lines being commonly trained over the first drum for winding and unwinding the two rear tow lines, and said single front tow line being trained over the second drum for winding and unwinding the front tow line.

9. The suspension system of claim 8 wherein the coupling means includes a shaft extending in the travel direction for connecting the first and second drums, said first and second drums being mounted on the shaft in spaced-apart fixed rotative engagement.

10. The suspension system of claim 9, and further comprising a motor for driving the shaft.

11. The suspension system of claim 8 wherein the tow lines are provided in the form of straps, and the first and second drums have different diameters.

12. The suspension system of claim 6 wherein the front tow line is twisted by about 90° on its downward deflection towards the load-bearing member.

13. A hoisting apparatus for transport of a person, comprising:

a lifting mechanism;

a drive mechanism for moving the lifting mechanism in a travel direction;

a load-bearing member for support of a person in sitting or recumbent position;

a suspension for connecting the load-bearing member to the lifting mechanism, said suspension including a framework having two base load tow lines extending downwardly from the lifting mechanism to the load-bearing member for substantially supporting the weight of a person, and front and rear tow lines secured to the lifting mechanism and extending downwardly for attachment to the load-bearing member; and a coupling unit for so interconnecting the front and rear tow lines with one another that the front and rear tow lines can move in opposite directions to rotate the person about its mass center, without substantially shifting the person's mass center.

14. The hoisting apparatus of claim 13 wherein the front and rear tow lines move at different speeds.

15. The hoisting apparatus of claim 13 wherein the front and rear tow lines are so positioned as to form of a three-point suspension with a single front tow line and two rear tow lines, with said three tow lines being trained over three pulleys in one-to-one correspondence, said coupling unit including a crossbar which extends transversely to the travel direction and interconnects the pulleys of the rear tow lines, said crossbar being swingable about an axis which is substantially parallel to the travel direction and extends in a center plane of the lifting mechanism.

16. The hoisting apparatus of claim 15 wherein the coupling unit includes a first drum, a second drum, and a shaft extending in the travel direction for connecting the first and second drums in spaced-apart fixed rotative engagement, said two rear tow lines being commonly trained over the first drum for winding and unwinding the two rear tow lines, and said single front tow line being trained over the second drum for winding and unwinding the front tow line.

17. The hoisting apparatus of claim 16 wherein the tow lines are provided in the form of straps, and the first and second drums have different diameters.

* * * * *